US012607069B2

(12) United States Patent
Kabiraj

(10) Patent No.: US 12,607,069 B2
(45) Date of Patent: Apr. 21, 2026

(54) DOWN-THE-HOLE HAMMER WITH PORTED PISTON AND FLOW CONTROL VALVE

(71) Applicant: Caterpillar Inc., Peoria, IL (US)

(72) Inventor: Koushik Kabiraj, Jharkhand (IN)

(73) Assignee: Caterpillar Inc., Peoria, IL (US)

( * ) Notice: Subject to any disclaimer, the term of this patent is extended or adjusted under 35 U.S.C. 154(b) by 120 days.

(21) Appl. No.: 18/318,627

(22) Filed: May 16, 2023

(65) Prior Publication Data

US 2024/0384597 A1 Nov. 21, 2024

(51) Int. Cl.
*E21B 1/30* (2006.01)

(52) U.S. Cl.
CPC ..... *E21B 1/30* (2020.05)

(58) Field of Classification Search
CPC ..... E21B 1/30
See application file for complete search history.

(56) References Cited

U.S. PATENT DOCUMENTS

| | | | |
|---|---|---|---|
| 4,530,408 | A | 7/1985 | Toutant |
| 5,085,284 | A | 2/1992 | Fu |
| 5,277,260 | A | 1/1994 | Ranck |
| 5,419,403 | A | 5/1995 | Klemm |
| 6,454,026 | B1 | 9/2002 | Shofner |
| 6,799,641 | B1 | 10/2004 | Lyon et al. |
| 7,353,890 | B2 | 4/2008 | Shofner |
| 8,176,995 | B1 | 5/2012 | Polsky et al. |
| 8,622,152 | B2 | 1/2014 | Lyon et al. |
| 9,016,403 | B2 | 4/2015 | Aros |
| 9,068,399 | B2 | 6/2015 | Lorger |
| 10,323,457 | B2 | 6/2019 | Boswell |
| 2014/0360783 | A1* | 12/2014 | Lyon ..... E21B 4/14 175/57 |

FOREIGN PATENT DOCUMENTS

| | | | |
|---|---|---|---|
| EP | 3553270 | B1 | 6/2021 |
| WO | 2017021339 | A1 | 2/2017 |

OTHER PUBLICATIONS

Written Opinion and International Search Report for Int'l. Patent Appln. No. PCT/US2024/024582, mailed Aug. 19, 2024 (12 pgs).

* cited by examiner

*Primary Examiner* — Dany E Akakpo

(57) ABSTRACT

A down-the-hole hammer includes a barrel having a longitudinal axis and defining a proximal chamber and a distal chamber, a piston slidable within the barrel between the proximal chamber and the distal chamber, and a flow control valve including a valve member slidable within the barrel along the longitudinal axis to control airflow through the piston. In a first position of the valve member, the valve member allows air flow from a proximal end of the barrel through the piston and into the distal chamber. In a second position of the valve member, the valve member allows air flow around the valve member and into the proximal chamber.

19 Claims, 10 Drawing Sheets

DOWN-THE-HOLE HAMMER WITH PORTED PISTON AND FLOW CONTROL VALVE

TECHNICAL FIELD

The present disclosure relates generally to drilling hammers, and more particularly, to a down-the-hole hammer having a ported piston and a flow control valve.

BACKGROUND

Surface drilling is a necessary operation in many industries including mining, oil and gas extraction, construction, geothermal drilling, and many others. Various types of equipment, referred to as drilling hammers, may be used to generate impact and percussive forces to break ground and advance a drilling bit through rock and soil. One class of hammers, known as down-the-hole hammers, are mounted to the bottom end of a drill string and include (or are directly adjacent to) the drilling bit. Down-the-hole hammers typically produce a hammering action by pneumatic or hydraulic action, with the motive fluid (e.g. air, water, or drilling mud) being supplied down the drill string to the hammer.

U.S. Pat. No. 10,323,457 issued on Jun. 18, 2019 ("the '457 patent"), describes a down-the-hole hammer having an inner tube assembly, a fluid flow control system, a bit retaining system, a porting sleeve, and a piston. The flow control system is arranged to define or form a flow path annulus through which air supplied from an upstream end of an associated drill pipe flows in order to subsequently drive the hammer. The porting sleeve interacts with an outer casing of the hammer to form a porting arrangement for directing air to the piston.

The flow control system of the '457 patent is a complex assembly of components that move relative to one another between various choke positions under pressure and the influence of a spring. Overall actuation of the hammer of the '457 patent requires complex and precise synchronous movement of the piston, flow control system, and porting sleeve. Additionally, the flow control system and porting sleeve occupy substantial space within the barrel that detracts from the available stroke of the piston.

The down-the-hole hammer of the present disclosure may solve one or more of the problems set forth above and/or other problems in the art. The scope of the current disclosure, however, is defined by the attached claims, and not by the ability to solve any specific problem.

SUMMARY

In one aspect, the present disclosure relates to a down-the-hole hammer including a barrel having a longitudinal axis and defining a proximal chamber and a distal chamber, a piston slidable within the barrel between the proximal chamber and the distal chamber, and a flow control valve including a valve member slidable within the barrel along the longitudinal axis to control airflow through the piston. In a first position of the valve member, the valve member allows air flow from a proximal end of the barrel through the piston and into the distal chamber. In a second position of the valve member, the valve member allows air flow around the valve member and into the proximal chamber.

In another aspect, the present disclosure relates to a method for operating a down-the-hole hammer including supplying pressurized inlet air to an adapter of the down-the-hole hammer, opening a check valve to allow pressurized inlet air to flow through a control tube, through a piston, and into a distal chamber of a barrel of the down-the-hole hammer, flowing air from a proximal chamber of the barrel through the piston and a bore of a bit, sliding the piston proximally in response to a first pressure differential between the proximal chamber and the distal chamber, in response to a pressure increase in the proximal chamber, sliding a valve member proximally to open a flow path between the adapter and the proximal chamber, flowing air from a valve chamber through an air distributor into piston, and flowing air from the distal chamber through the bore of the bit, in response to a second pressure differential between the proximal chamber and the distal chamber, sliding the piston distally within barrel to impact the bit, and, in response to the piston sliding distally in the barrel, sliding the valve member distally within barrel.

In another aspect, the present disclosure relates to a down-the-hole hammer including a barrel having a longitudinal axis and defining a proximal chamber and a distal chamber, a piston slidable within the barrel along the longitudinal axis in response to a pressure differential between the proximal chamber and the distal chamber, and a flow control valve providing selective fluid communication into the proximal chamber of the barrel. The piston includes a proximal internal cavity, a distal internal cavity, at least one first port extending from the proximal internal cavity to an intermediate outer surface of the piston, at least one second port extending from the proximal internal cavity to a distal outer surface of the piston, and at least one third port extending from the distal internal cavity to the intermediate outer surface of the piston.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Figure 1:
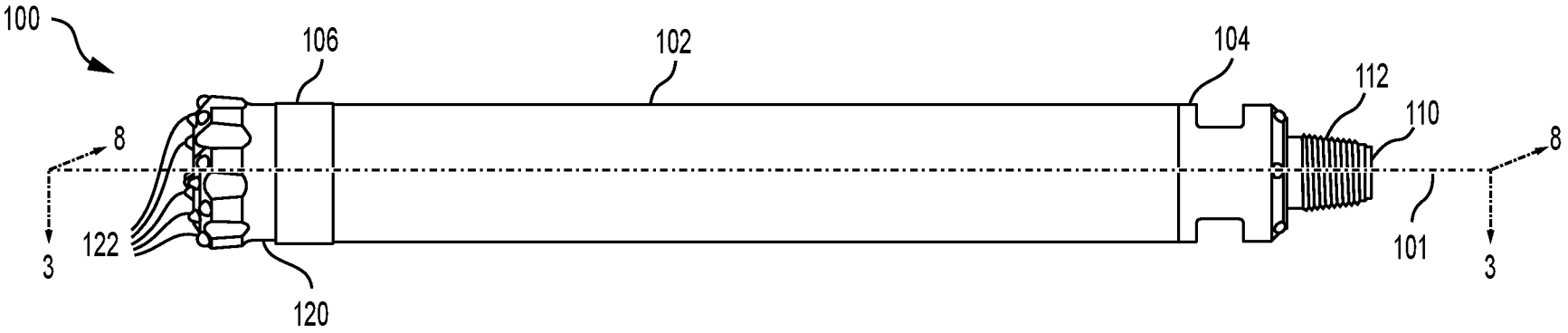
FIG. 1 is a side view of a down-the-hole hammer, according to aspects of the present disclosure.

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value. Throughout the accompanying drawings, like reference numerals refer to like components.

Figure 2:
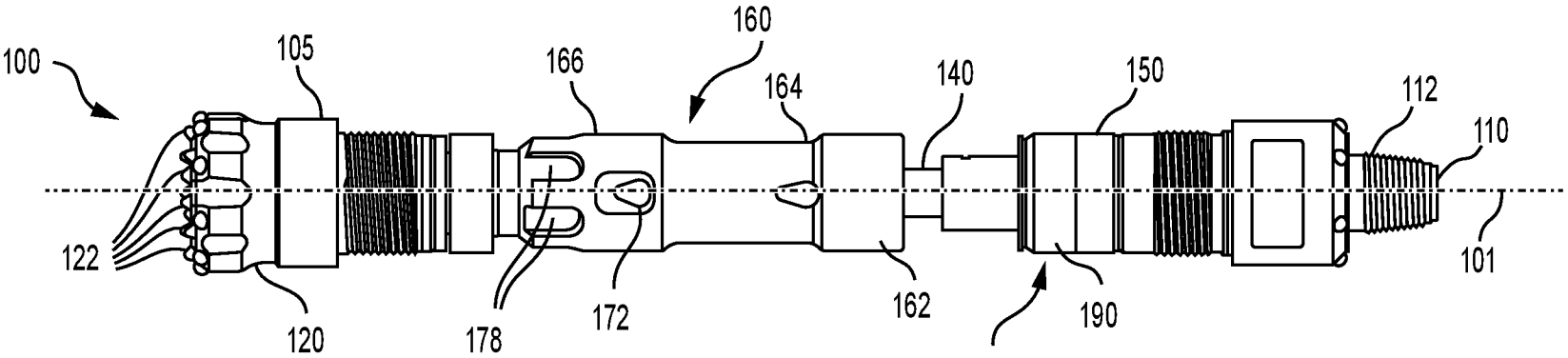
FIG. 2 is a side view of the down-the-hole hammer of FIG. 1, with the barrel thereof removed to show internal components.
Figure 3:
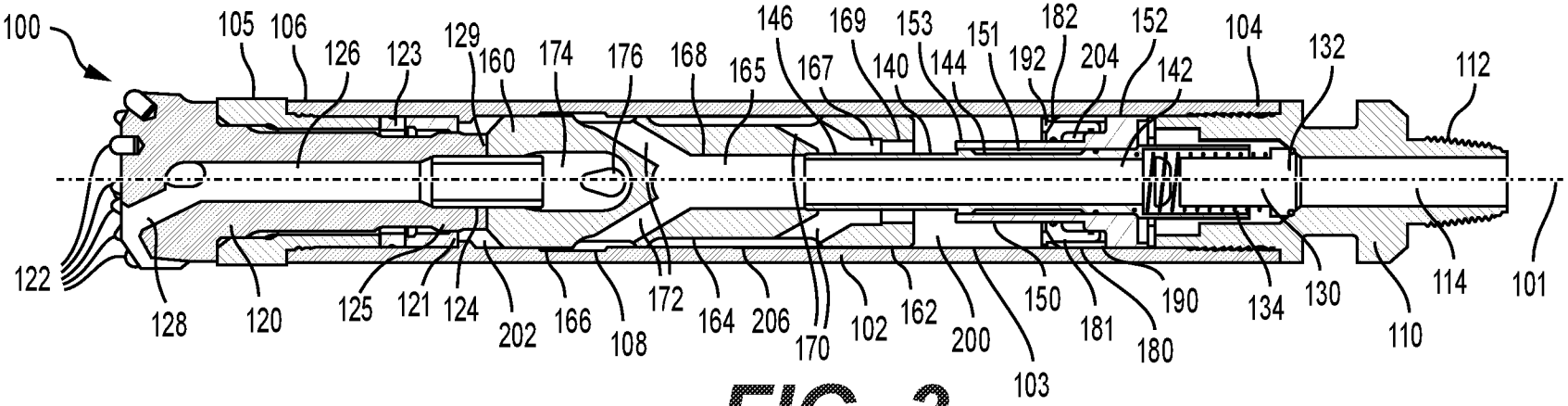
FIG. 3 is a cross-sectional side view of the down-the-hole hammer of FIG. 1, viewed along section line 3-3 of FIG. 1.

Referring now to FIGS. 1, 2 and 3, a down-the-hole drilling hammer (hereinafter "hammer 100") in accordance with aspects of the present disclosure includes a barrel 102 housing various other components of hammer 100. Barrel 102 defines a longitudinal axis 101 extending from a top (or proximal) end 104 to a bottom (or distal) end 106 of barrel 102. Barrel 102 is generally cylindrical and includes an inner diameter that defines a bore 103 (see FIG. 3) extending from proximal end 104 to distal end 106. The bore of barrel 102 includes an annular recess 108 (see FIG. 3) that provides a flow path to selectively allow airflow between various regions of barrel 102 during operation of hammer 100, as will be described herein.

An adapter 110 is connected to proximal end 104 of barrel 102, for example by a threaded connection. Adapter 110 includes an interface 112, for example a threaded fitting as illustrated, for connection to a drill string (not shown). Adapter 110 further includes a bore 114 that receives pressurized air supplied from the drill string (e.g., via a compressor).

Hammer bit (hereinafter "bit 120") is disposed in distal end 106 of barrel 102 in a manner that allows limited sliding of bit 120 along longitudinal axis 101. In particular, a drive chuck 105 is threaded into distal end 106 of barrel 102. Drive chuck 105 includes an internal anti-rotation feature (e.g., splines) that interact with complementary features on bit 120 to allow bit 120 to slide along axis 101 but not rotate relative to barrel 102. When threaded into barrel 102, drive chuck 105 retains a stop ring 123 (which may be formed of two half rings) within barrel 102 adjacent a guide sleeve 121. Stop ring 123 limits distal travel of bit 120 by engaging a protrusion 125 of bit 120 (see FIG. 3) when bit 120 is at a distal-most position, thereby preventing bit 120 from sliding out of barrel 102. Bit 120 includes a distal end having one or more digging features 122 (e.g., tips, teeth, etc.) for cutting/breaking ground and/or rock. Bit 120 is connected or integrally formed with a foot valve 124. A bore 126 extends through foot valve 124 and at least partially through bit 120. An exhaust port 128 extends from bore 126 and opens to an external surface (e.g., the distal end) of bit 120. Bit 120 includes a strike face 129 that is struck by a piston 160 of hammer 100 to cause bit 120 to create an impact against the ground, a rock face, etc., as will be described in greater detail herein. In some aspects, hammer 100 may lack foot valve 124, with the design of bit 120 and/or piston 160 being modified to perform the same functionality as foot valve 124.

A check valve 130 is disposed within barrel 102 adjacent to adapter 110, and is configured to open in response to air pressure supplied to bore 114 of adapter 110. Check valve 130 is configured to close when pressure with hammer 100 exceeds pressure in drill string (not shown). As such, check valve 130 may close at times during operation of hammer 100, depending on the relative air pressure between hammer 100 and the drill string. Check valve 130 may include a plug 132 biased against a shoulder or other surface of bore 114 by a spring 134. Spring 134 may be configured to compress when a predetermined air pressure acts against plug 132, allowing plug 132 to slide distally within bore 114 and air to pass by plug 132 toward distal end 106 of barrel 102.

A control tube 140 having a hollow bore 142 extending parallel to longitudinal axis 101 is fixed within barrel 102. Control tube 140 may extend at least partially into bore 114 of adapter 110. Spring 134 of check valve 130 may be seated in a shoulder of bore 142 of control tube 140. Bore 142 is in fluid communication with bore 114 of adapter 110 when check 130 is opened by air pressure. That is, air flowing past check valve 130 may flow into bore 142 of control tube 140. Control tube 140 includes a recess 144 extending partially along an outer surface of control tube 140. Recess 144 provides a path for air flow to various components and chambers of hammer 100, in particular to actuate a flow control valve 180 of hammer 100 during the stroke of piston 160, as will be described herein. In some aspects, recess 144 may extend completely around a circumference of control tube 140. In other aspects, recess 144 may be a slot or groove. Control tube 140 includes a distal end 146 extending toward distal end 106 of barrel 102. Bore 142 extends through distal end 146 of control tube 140.

Figure 4:
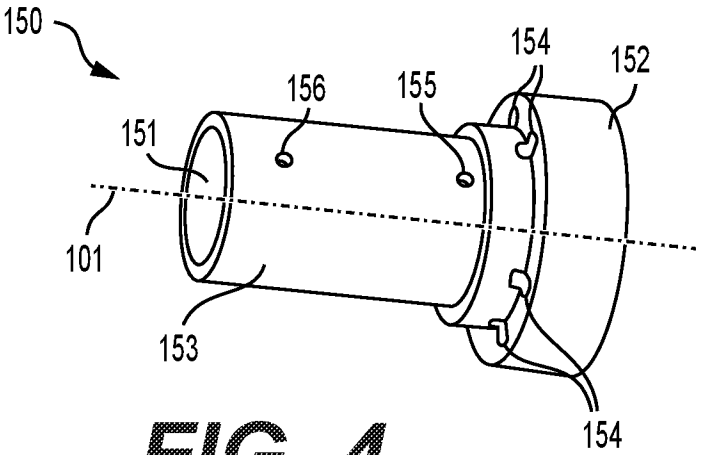
FIG. 4 is a perspective view of an air distributor of the down-the-hole hammer of FIG. 1.
Figure 7:
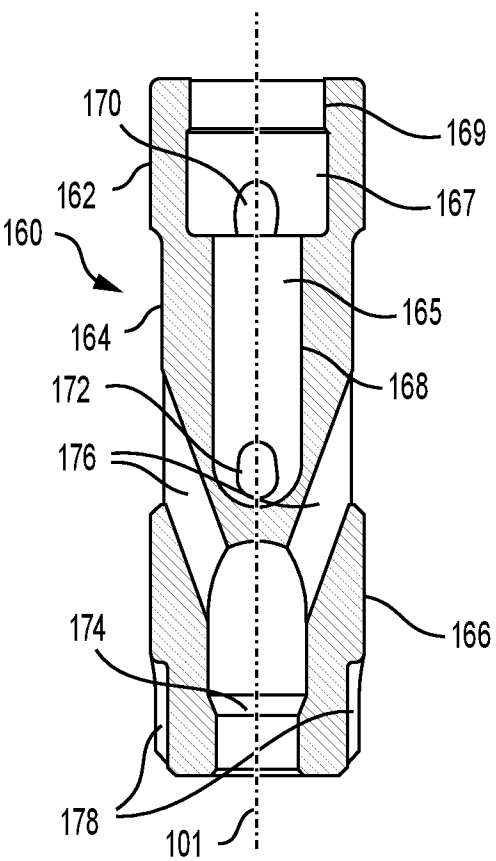
FIG. 7 is a cross-sectional side view of the piston of FIG. 5, viewed along section line 7-7 of FIG. 5.
Figure 6:
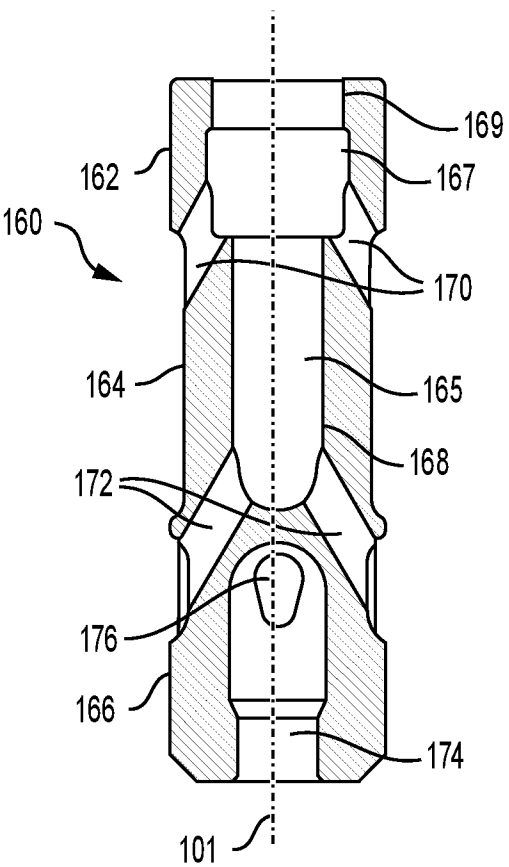
FIG. 6 is a cross-sectional side view of the piston of FIG. 5, viewed along section line 6-6 of FIG. 5.
Figure 5:
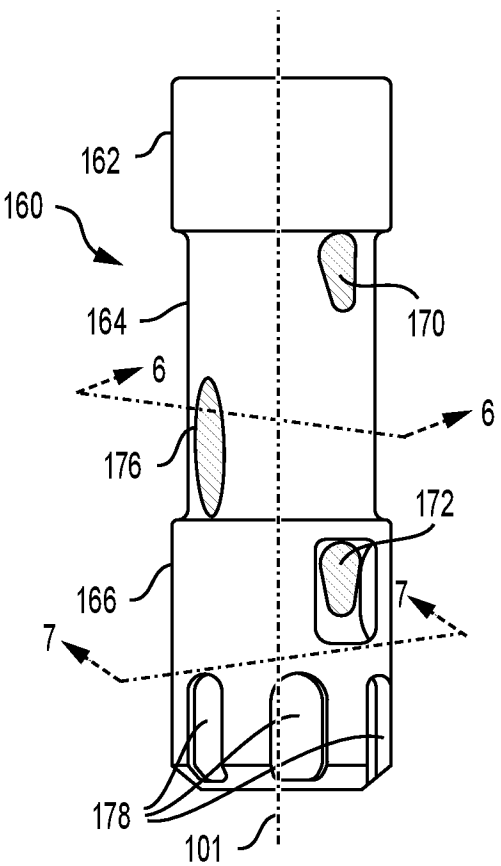
FIG. 5 is a side view of a piston of the down-the-hole hammer of FIG. 1.

With continued reference to FIGS. 1-3 and further reference to FIG. 4, an air distributor 150 having a bore 151 is disposed about control tube 140. Air distributor 150 includes a proximal flange 152 and a distal tube 153. At least one flange port 154 extends longitudinally through flange 152. At least one proximal port 155 and at least one distal port 156 extend through distal tube 153 and into bore 151. Proximal port(s) 155 and distal port(s) 156 are spaced apart from one another a predetermined distance. The predetermined distance may be selected to optimize operation of hammer 100 for a particular flow rate and/or pressure of air supplied to adapter 110. Air distributor 150 is disposed about control tube 140 such that ports 155, 156 are in fluid communication with recess 144 defined by control tube 140 (see, e.g., FIG. 8). The inner diameter of distal tube 153 of air distributor 150 is sealed against control tube 140 on either side of recess 144. Thus, ports 155, 156 provide the only fluid communication into and out of a chamber defined by recess 144 of control tube 140 and bore 151 of air distributor 150.

With reference to FIGS. 1-3 and 5-7, a piston 160 is slidably disposed within barrel 102. Piston 160 is configured to slide parallel to longitudinal axis 101 in response to a pressure differential between opposite ends of piston 160, as will be described herein. Piston 160 includes a proximal outer surface 162 configured to create a substantially airtight seal with an internal surface of barrel 102 to prevent air flowing past piston 160. Piston 160 further includes an intermediate outer surface 164 having a smaller diameter than proximal outer surface 162 and located distally of proximal outer surface 162. Intermediate outer surface 164 defines an intermediate chamber 206 with an internal surface of barrel 102. Piston 160 further includes a distal outer surface 166 located distally of intermediate outer surface 164. Distal outer surface 166 may have substantially the same outer diameter as proximal outer surface 162, and is configured to create a substantially airtight seal with an internal surface of barrel 102 to prevent air flowing past distal outer surface 166 into and/or out of intermediate chamber 206.

Piston 160 defines a proximal internal cavity 168 configured to receive (during various operating stages of hammer 100) distal end 146 of control tube 140 and distal tube 153 of air distributor 150. Proximal internal cavity 168 includes a distal section 165 having a diameter substantially equal to an outer diameter of distal end 146 of control tube 140, an enlarged section 167 having a diameter larger than an outer diameter of distal tube 153 of air distributor 150, and a proximal lip 169 having a diameter approximately equal to an outer diameter of distal tube 153 of air distributor 150. Distal section 165 of proximal internal cavity 168 form a substantially airtight seal with distal end 146 of control tube 140 in some operational positions of hammer 100, as will be described herein. Proximal lip 169 of proximal internal cavity 168 form a substantially airtight seal with distal tube 153 of air distributor 150 in some operational positions of hammer 100, as will be described herein.

At least one first port 170 extends from enlarged section 167 of proximal internal cavity 168 to intermediate outer surface 164. At least one second port 172 extends from distal section 165 of proximal internal cavity 168 to distal outer surface 166. In some aspects, at least one first port 170 and/or at least one second port 172 include two ports, respectively, and extend at an obtuse angle from proximal internal cavity 168 toward bit 120 as shown in FIG. 3.

Piston 160 further includes one or more passageways 178 recessed into distal outer surface 166, and extending from the distal end of distal outer surface 166 toward intermediate outer surface 164. Passageway(s) 178 terminate distally of second port(s) 172. Passageway(s) 178 allow air to flow from second port(s) 172 between barrel 102 and piston 160 when second port(s) 172 are aligned with recess 108 of barrel 102, as will be described in more detail herein. In some aspects, one or more passageways 178 include six passageways spaced equally about the circumference of the piston 160.

Piston 160 further defines a distal internal cavity 174 configured to receive foot valve 124 of bit 120. Distal internal cavity 174 has a diameter substantially equal to an outer diameter of foot valve 124 such that a substantially airtight seal is formed between distal internal cavity 174 and foot valve 124 when foot valve 124 is inserted into distal internal cavity 174. At least one third port 176 extends from distal internal cavity 174 to intermediate outer surface 164 of piston 160. In some aspects, the at least on third port 176 includes two ports, and the ports extend at an obtuse angle from distal internal cavity 174 toward adapter 110.

Piston 160 is arranged inside barrel 102 so that a proximal chamber 200 is defined between a proximal end of piston 160 and a valve seat 190 of flow control valve 180. Further, a distal chamber 202 is defined between bit 120 and a distal end of piston 160.

Referring again to FIGS. 1-3, flow control valve 180 of hammer 100 further includes a valve member 181 slidably mounted on an outer surface of air distributor 150. Valve member 181 defines a valve chamber 204 with an outer surface of air distributor 150. Valve member 181 is held captive by air distributor 150 and valve seat 190 to limit sliding of valve member 181. In particular, a distal surface 182 of valve member 181 engages a distal surface 192 of valve seat 190 to limit distal travel of valve member 181, while proximal flange 152 of air distributor 150 limits proximal travel of valve member 181.

Valve member 181 is configured to slide along longitudinal axis 101 between a first (distal) position and a second (proximal) position. In the first position (see FIG. 16A), with distal surface 182 of valve member 181 engaging distal surface 192 of valve seat 190, valve member 181 prevents air flow from adapter 110 into proximal chamber 200. In the second position (see FIG. 16B), with valve member 181 slid proximally so that distal surface 182 is spaced apart from distal surface 192 of valve seat 190, adapter 110 is in fluid communication with proximal chamber 200 via flange port 154 of air distributor 150. Thus, valve member 181 provides selective fluid communication between adapter 110 and proximal chamber 200, as will be described in greater detail herein. Valve member 181 aligns with air distributor 150 such that proximal port(s) 155 of air distributor 150 is in fluid communication with valve chamber 204 regardless of the position of valve member 181 relative to air distributor 150.

INDUSTRIAL APPLICABILITY

The disclosed aspects of hammer 100 as set forth in the present disclosure may be used for breaking and/or pulverizing ground surfaces, particularly rock surfaces, during a drilling operation. Particularly, hammer 100 of the present disclosure generates repeated impact forces to break ground surfaces to advance a drill string below grade. Referring now to FIGS. 8-16B, hammer 100 is configured to generate such impact forces with bit 120 by cycling through various operational positions in response to pressurized air being supplied from a drill string (not shown) attached to adapter 110. Hammer 100 generates these impact forces by reciprocating piston 160 within barrel 102 to strike bit 120. Further, hammer 100 may be configured to rotate along with the drill string attached to adapter 110 to enhance drilling efficiency.

Figure 8:
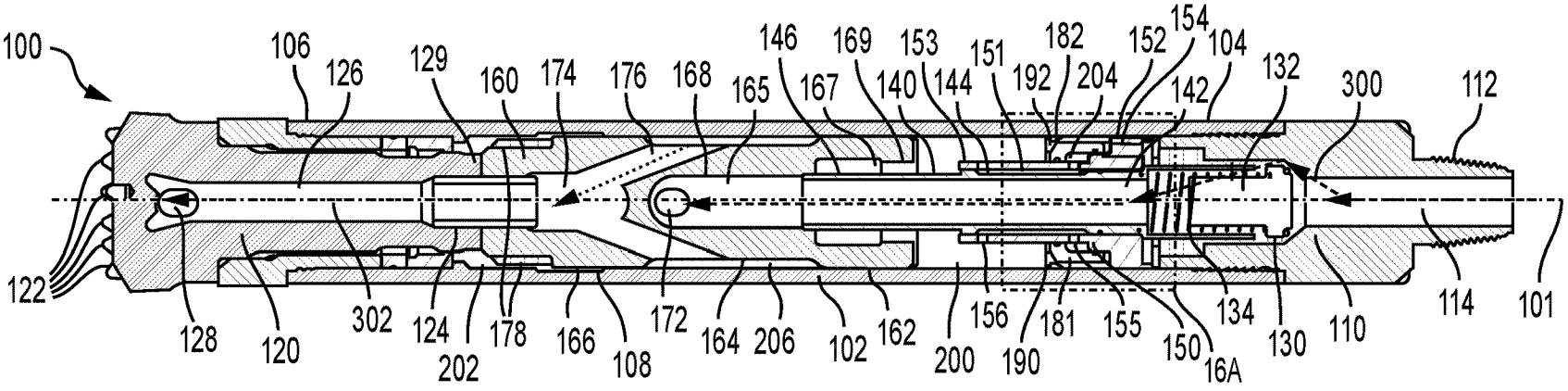
FIG. 8 is a cross-sectional side view of the down-the-hole hammer of FIG. 1 in a first operating position, viewed along section line 8-8 of FIG. 1.
Figure 9:
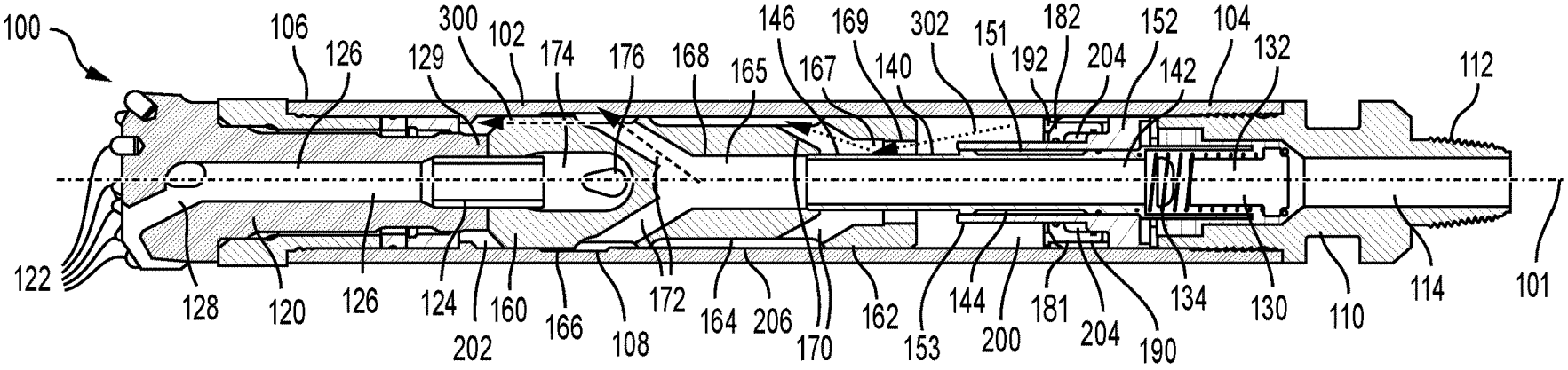
FIG. 9 is a cross-sectional view of the down-the-hole hammer of FIG. 1 in the first operating position, viewed along section line 3-3 of FIG. 1.

Referring now to FIGS. 8 and 9, in a first operational position, piston 160 abuts strike face 129 of bit 120. First operational position may correspond to piston 160 having just delivered an impact to bit 120. Pressurized inlet air supplied to adapter 110 (e.g., via an external compressor) can flow through hammer 100 along the path indicated by arrow 300. In particular, the inlet air depresses plug 132 of check valve 130, allowing the inlet air to flow around check valve 130 into bore 142 of control tube 140. Control tube 142 is received in proximal internal cavity 168 of piston 160, so the air enters proximal internal cavity 168. From proximal internal cavity 168, the inlet air flows through second port(s)

172. With piston 160 abutting bit 120, second port(s) 172 are aligned with recess 108 of barrel 102. Thus, the inlet air can flow out of second port(s) 172, into recess 108, through passageway(s) 178 and into distal chamber 202 of barrel 102.

Figure 16A:
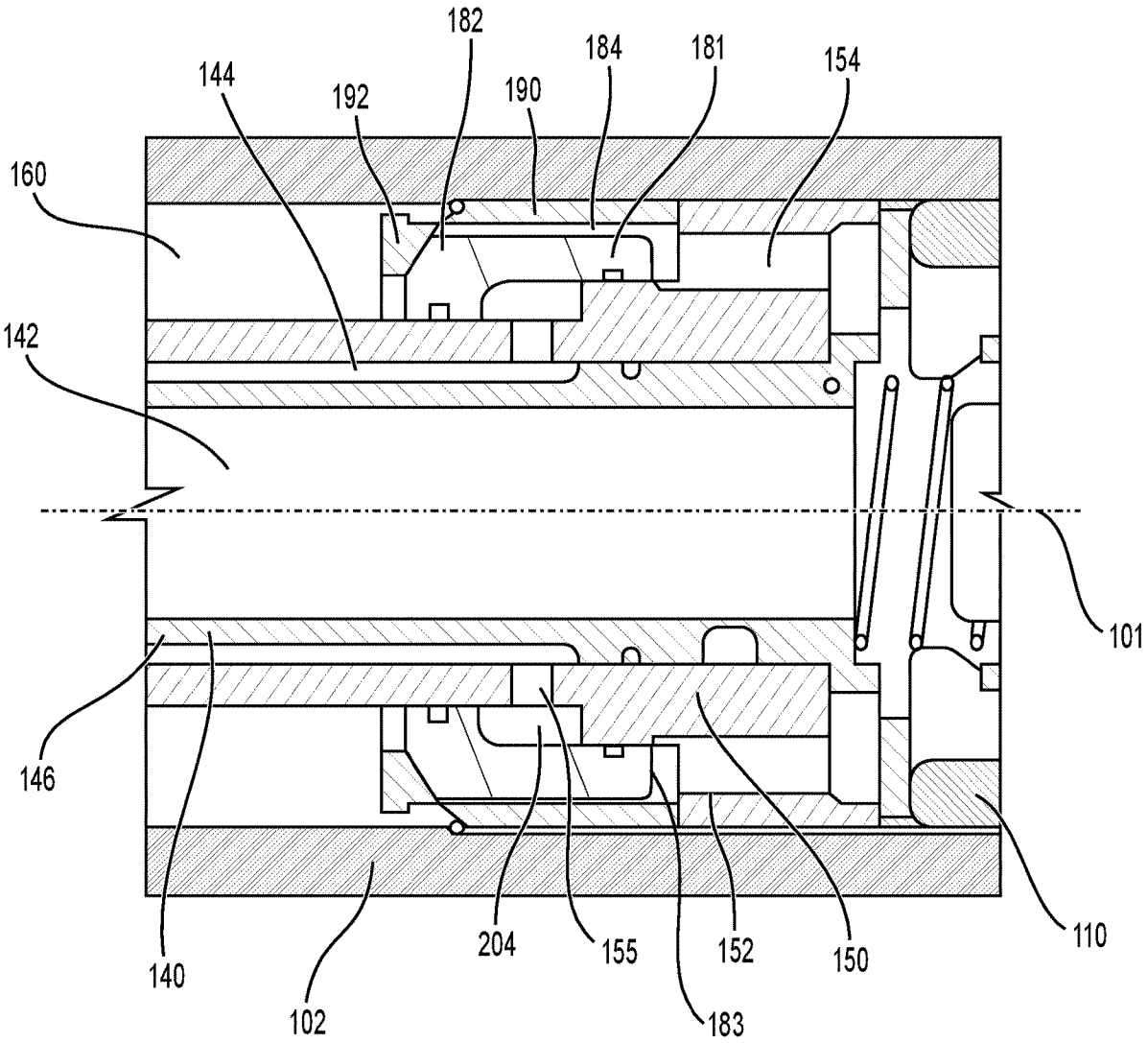
FIG. 16A is a detail view of a flow control valve and associated components of detail 16A of FIG. 8.

The combined effect of air pressure in flange port 154, air pressure in proximal chamber 200, and air pressure in valve chamber 204 maintains valve element 181 of flow control valve 180 in the first (distal) position so that distal surface 182 of valve member 181 engages distal surface 192 of valve seat 190. An enlarged, detail view of flow control valve 180 and associated components, in the first operational position of hammer 100, is illustrated in FIG. 16A. While air flowing past plug 132 can reach flange port 154 of air distributor 150, air cannot flow past valve element 181 and therefore cannot flow into proximal chamber 200. More particularly, air can flow no farther than a gap 184 between an outer surface of valve element 181 and valve seat 190, as engagement of distal surface 182 of valve member 181 with distal surface 192 of valve seat 190 prevents further airflow toward proximal chamber 200.

Concurrently with the inlet air flowing in the direction of arrow 300, exhaust air exits hammer 100 by flowing in the direction of arrow 302. The exhaust air constitutes the air present in proximal chamber 200 of barrel 102 which must be evacuated to complete a stroke of hammer 100. The exhaust air flows between control tube 140 and proximal lip 169 of proximal internal cavity 168 of piston 160, and into enlarged section 167 of proximal internal cavity 168. The outer diameter of control tube 140 forms a seal with distal section 165 of proximal inner cavity, so the exhaust air cannot flow from enlarged section 167 around the outside of control tube 140 into distal section 165. Rather, the exhaust air flows through first port(s) 170 into intermediate chamber 206, and then from intermediate chamber 206 through third port(s) 176 and into distal internal cavity 174 of piston 160. From distal internal cavity 174, the exhaust air flow through bore 126 in foot valve 124 and bit 120, and out of exhaust port 128.

As the inlet air fills distal chamber 202 of barrel 102 at the same time the exhaust air is able to flow out of proximal chamber 200, a pressure differential is created between proximal chamber 200 and distal chamber 202. Particularly, air pressure in distal chamber 202 increases and exceeds air pressure in proximal chamber 200. This pressure differential induces piston 160 to slide proximally away from bit 120, as shown in FIGS. 10 and 11.

Figure 10:
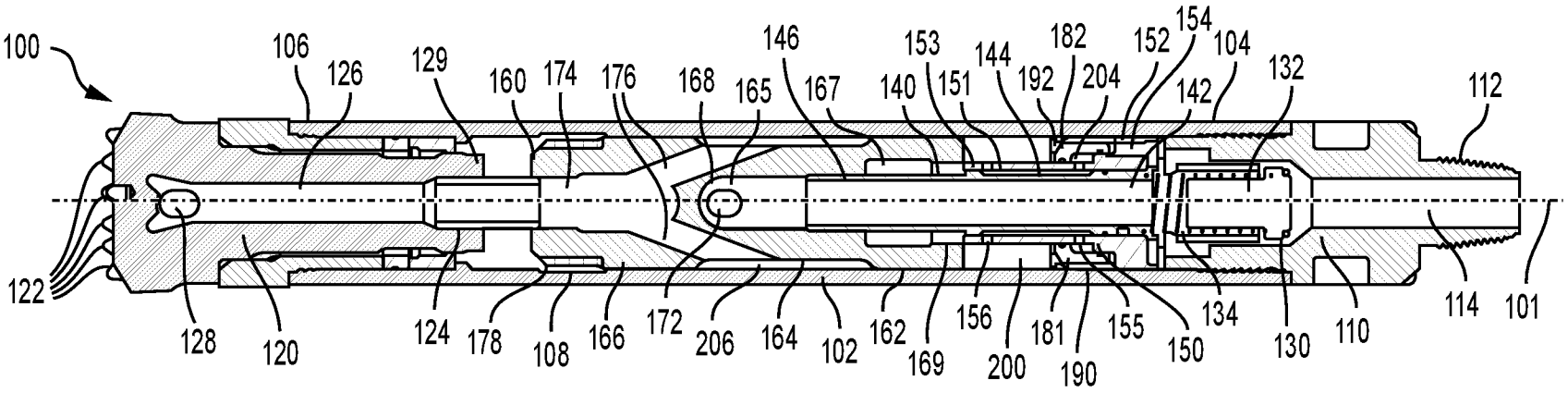
FIG. 10 is a cross-sectional side view of the down-the-hole hammer of FIG. 1 in a second operating position, viewed along section line 8-8 of FIG. 1.
Figure 11:
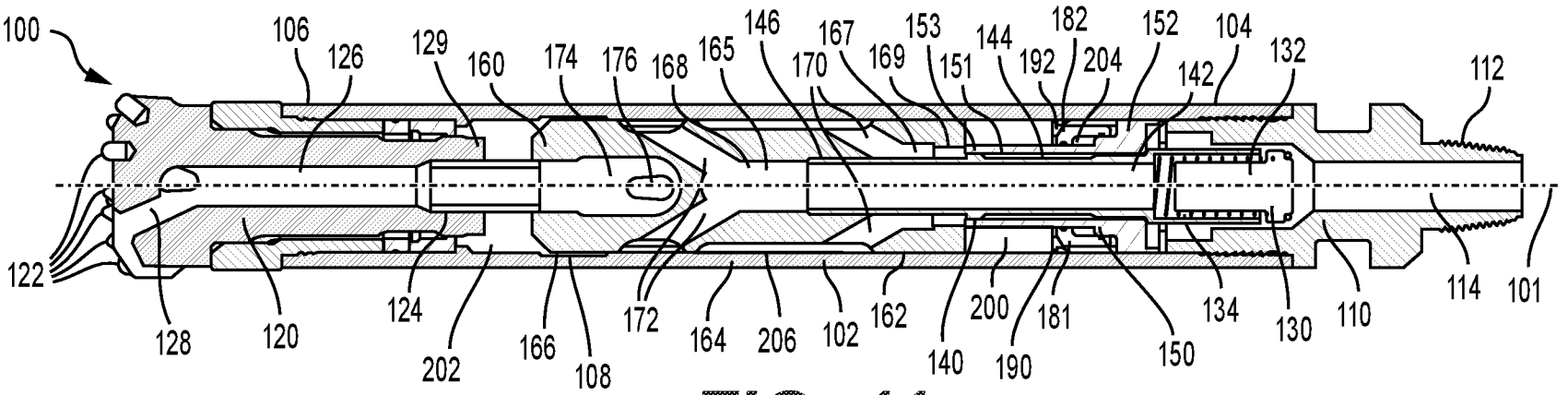
FIG. 11 is a cross-sectional side view of the down-the-hole hammer of FIG. 1 in the second operating position, viewed along section line 3-3 of FIG. 1.

Referring now to FIGS. 10 and 11, a second operational position of hammer 100 is illustrated. In second operational position, piston 160 slides proximally in barrel 102 along longitudinal axis 101. As piston 160 slides, second port(s) 172 move out of alignment with recess 108 of barrel 102, causing second port(s) 172 to be choked by the inner sidewall of the barrel 102. As such, inlet air is no longer able to flow out of second ports(s) 172, into recess 108, through passageway(s) 178, and into distal chamber 202. Thus, no additional air enters distal chamber 202. However, inertia of piston 160 causes piston 160 to continue to slide proximally toward adapter 110, which causes the air in distal chamber 202 to expand, and therefore reduce in pressure.

Also as piston 160 slides proximally in barrel 102, distal tube 153 of air distributor 150 engages proximal lip 169 of proximal internal cavity 168 of piston 160. Because proximal lip 169 has an inner diameter substantially equal to the outer diameter of distal tube 153 of air distributor 150, air is unable to flow between proximal lip 169 and air distributor 150. As such, proximal chamber 200 of barrel 102 becomes choked as air can no longer flow out of proximal chamber 200 into proximal internal cavity 168. Therefore, as inertia causes piston 160 to slide proximally, the air trapped in proximal chamber 200 is compressed and increases in pressure.

In second operational position of FIGS. 10 and 11, foot valve 124 remains partially inserted into distal internal cavity of piston 160, so air in distal chamber 202 cannot escape distal chamber 202 to bore 126.

Figure 12:
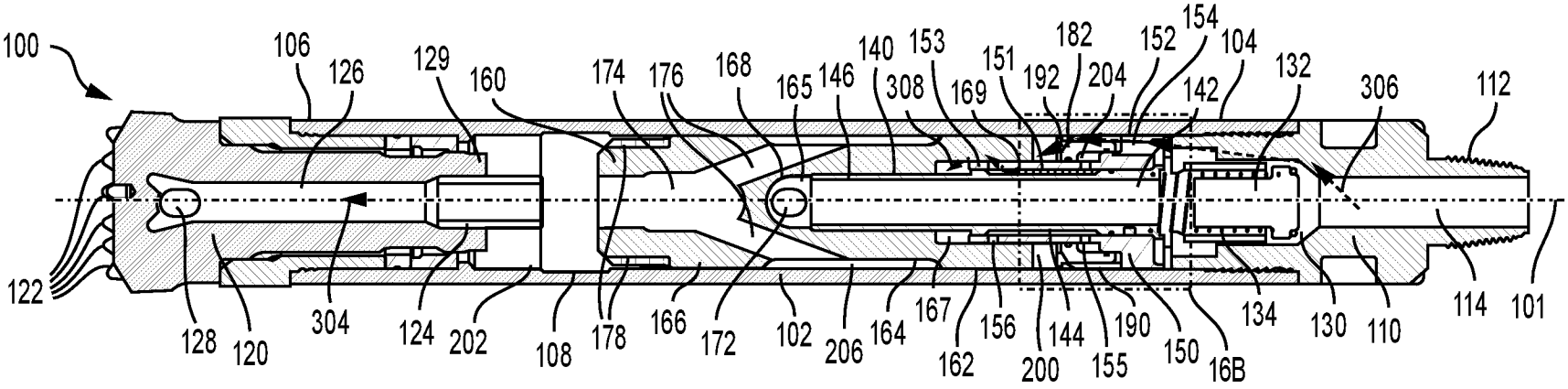
FIG. 12 is a cross-sectional side view of the down-the-hole hammer of FIG. 1 in a third operating position, viewed along section line 8-8 of FIG. 1.
Figure 13:
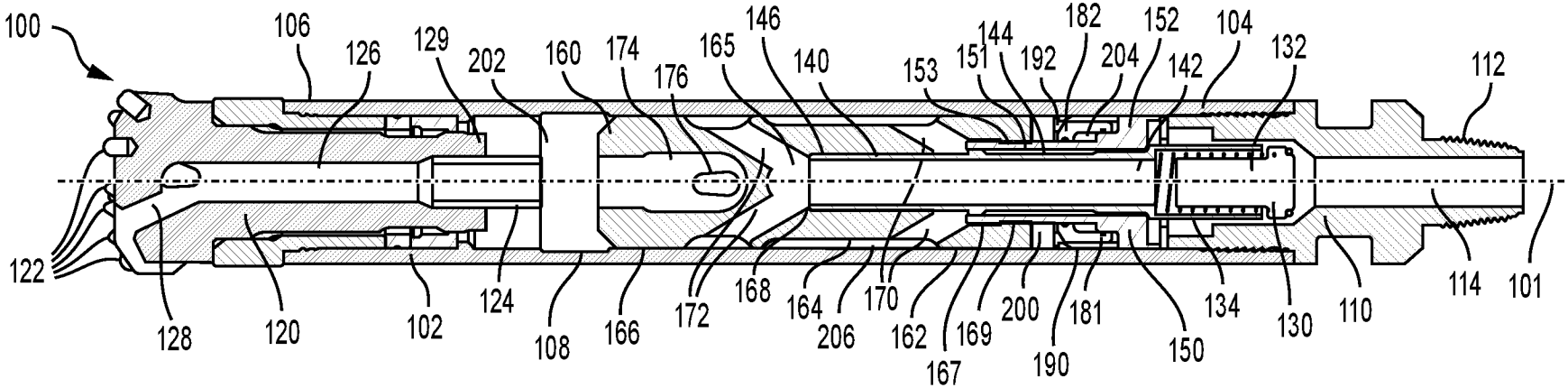
FIG. 13 is a cross-sectional side view of the down-the-hole hammer of FIG. 1 in the third operating position, viewed along section line 3-3 of FIG. 1.

Referring now to FIGS. 12 and 13, a third operational position of hammer 100 is illustrated. As piston 160 continues to slide proximally due to inertia of piston 160, the inner diameter of piston 160 clears foot valve 124. Thus, air previously trapped in distal chamber 202 may escape through bore 126 of foot valve 124 and bit 120, and ultimately exit hammer 100 through exhaust port 128, as illustrated by arrow 304 in FIG. 12. Proximal sliding of piston 160 further causes distal port(s) 156 of air distributor 150 to clear proximal lip 169 of proximal internal cavity 168 of piston 160. Distal port(s) 156 is thus in fluid communication with enlarged section 167 of proximal internal cavity 168. Exhaust air trapped in valve chamber 204 can therefore flow through proximal port(s) 155 of air distributor 150, through bore 151, out distal port(s) 156, and into enlarged section 167 of proximal internal cavity 168. This exhaust air flow is illustrated by arrow 308 in FIG. 12. The exhaust air in enlarged section 167 flows out of port(s) 170 into intermediate chamber 206, and through third port(s) 176 into distal internal cavity 174, from where the exhaust air meets and joins with the exhaust air flowing out of distal chamber 202 (i.e., in the direction of arrow 304) to exhaust port 128. Thus, valve chamber 204 is depressurized, which allows valve member 181 to slide proximally away from distal surface 192 of valve seat 190.

Figure 16B:
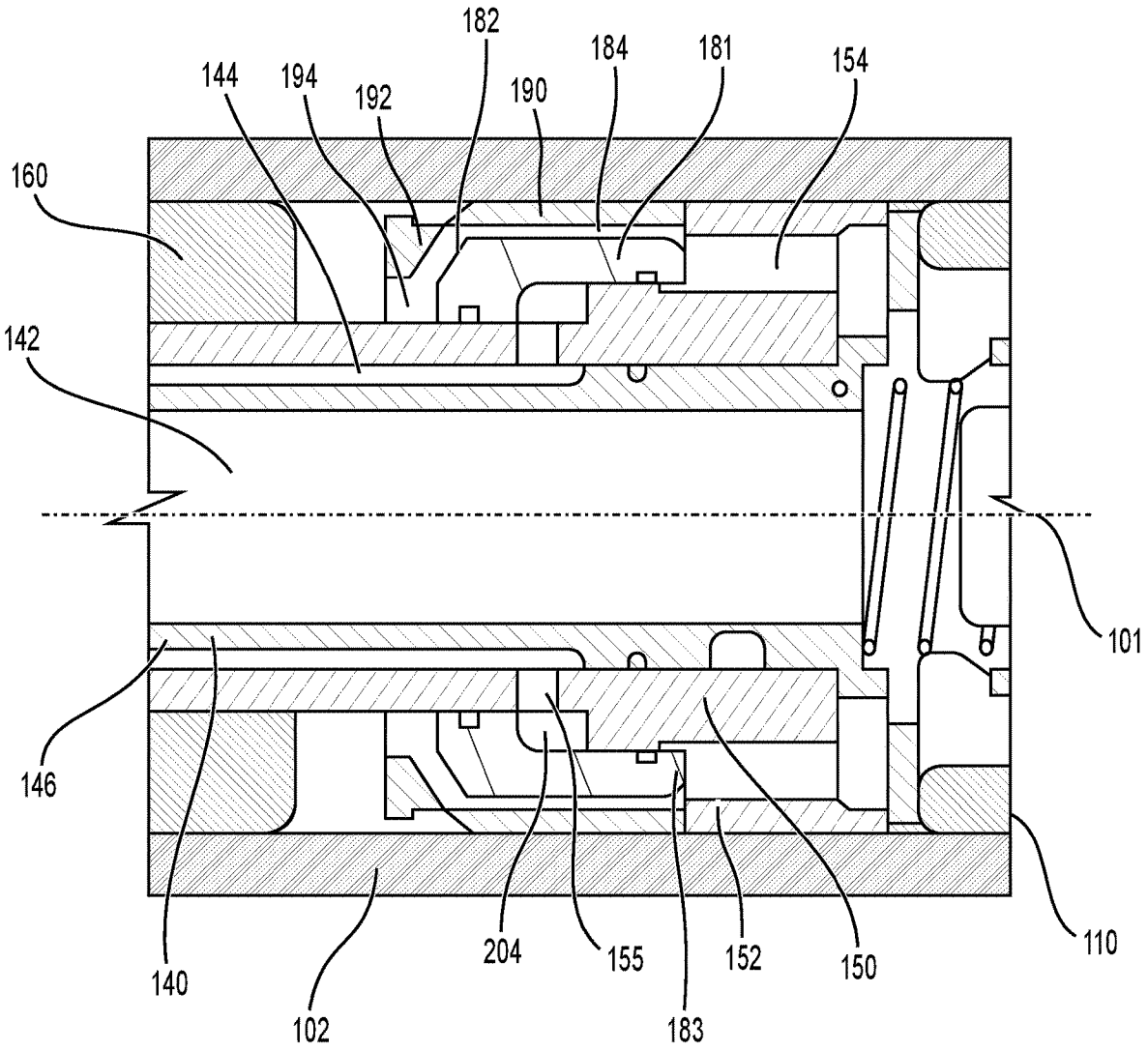
FIG. 16B is a detail view of a flow control valve and associated components of detail 16B of FIG. 12.

An enlarged, detail view of flow control valve 180 and associated components, in the third operational position of hammer 100, is illustrated in FIG. 16B. As shown in FIGS. 12, 13, and 16B, valve member 181 slides proximally until a proximal end 183 of valve member 181 contacts proximal flange 152 of air distributor 150. Flange port 154 of air distributor 150 are located at least partially radially outward of valve member 181, so that air can flow through flange port 154 and around the outside of valve member 181 even when proximal end 183 of valve member 181 is in contact with proximal flange 152 of air distributor. In particular, air can flow through flange port 154 into gap 184 (see FIG. 16B) between outer surface of valve member 181 and valve seat 190. Thus, in the third operational position of hammer 100, inlet air supplied to adapter 110 can flow through flange port 154 of air distributor 150 around valve member 181 (via gap 184), between distal surface 182 of valve member 181 and distal surface 192 of valve seat 190, and through a space 194 between valve seat 190 and air distributor 150 into proximal chamber 200. This inlet air flow is illustrated by arrow 306 in FIG. 12.

With continued reference to FIGS. 12 and 13, the inlet air flowing into proximal chamber 200 (along arrow 306) increases the pressure in proximal chamber 200. Conversely, the air pressure in distal chamber 202 is substantially at atmospheric pressure because the exhaust air in distal chamber 200 is free to vent through bore 126 of foot valve 124 and bit 120 to exhaust port 128. Thus, a pressure differential is created between proximal chamber 200 and distal chamber 202, with proximal chamber 200 having a higher air pressure than distal chamber 202. The relatively higher air pressure in proximal chamber 200 acts against the proximal face of piston 160, causing piston 160 to decelerate and eventually stop before contacting valve seat 190 (and/or or other components proximal of piston 160) at the proximal end of the piston stroke. That is, the inlet air in proximal chamber 200 acts as a cushion to bring piston 160 to a controlled stop. Once piston 160 has stopped sliding proximally, the inlet air in proximal chamber 200 continues to act against the proximal face of piston 160 to cause piston 160 to slide back toward bit 120, as shown in FIGS. 14 and 15.

Figure 14:
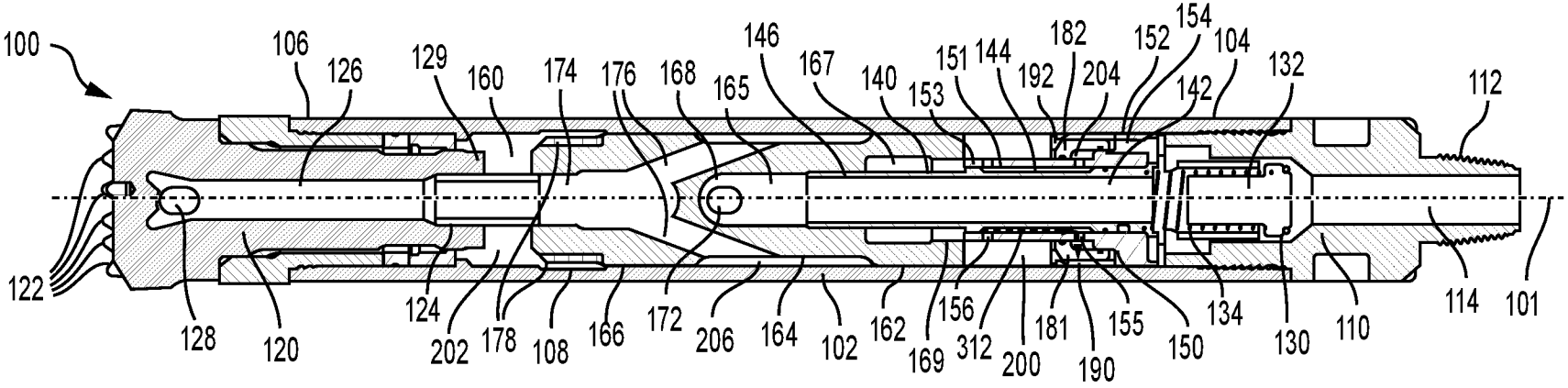
FIG. 14 is a cross-sectional view of the down-the-hole hammer of FIG. 1 in a fourth operating position, viewed along section line 8-8 of FIG. 1.
Figure 15:
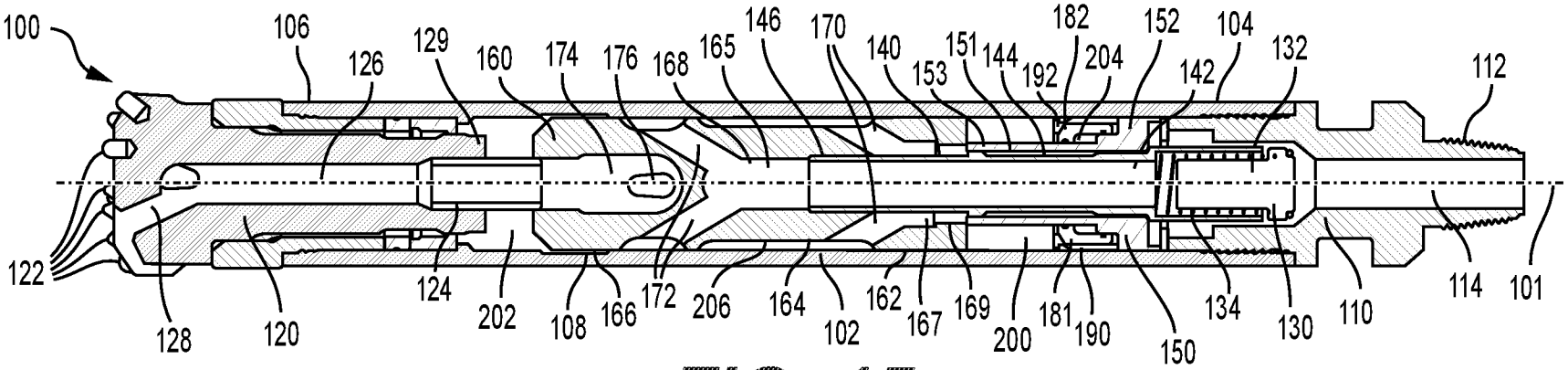
FIG. 15 is a cross-sectional view of the down-the-hole hammer of FIG. 1 in the fourth operating position, viewed along section line 3-3 of FIG. 1.

Referring now to FIGS. 14 and 15, a fourth operational position of hammer 100 is illustrated, in which piston 160 again slides toward bit 120 due to pressure in proximal chamber 200. As piston 160 slides toward bit 120, proximal lip 169 of piston 160 clears distal port(s) 156 of air distributor 150, placing distal port(s) 156 into fluid communication with proximal chamber 200. This allows inlet air in proximal chamber 200 to flow into bore 151 of air distributor 150 and out proximal port 155 of air distributor 150 into valve chamber 204, as illustrated by arrow 312 of FIG. 14. As the volume of air in valve chamber 204 increases, control valve 181 slides distally to increase the volume of valve chamber 204 to accommodate more air. Valve member 181 continues to slide distally until distal surface 182 of valve member 181 contacts distal surface 192 of valve seat 190, thereby closing the flow path between valve member 181 and valve seat 190 and thus closing air flow into chamber 200.

As piston 160 continues to slide distally in barrel 102, foot valve 124 is received by distal internal cavity 174, which isolates distal chamber 202 of barrel 102 from bore 126 of foot valve 124 and bit 120. As such, exhaust air is temporarily unable to flow from distal chamber 202 to exit port 128, causing a pressure increase in distal chamber 202. As piston 160 continues to move distally in barrel 102, piston eventually impacts strike face 129 of bit 120. Additionally, second port(s) 172 align with recess 108 of barrel 102, providing fluid communication between distal chamber 202 and second port(s) 172 via passageway(s) 178. Thus, hammer 100 is back at first operational position shown in FIGS. 8 and 9, at which point air can flow into distal chamber 202 from control tube 140 via second port(s) 172 and passageway(s) 178.

Hammer 100 repeats the cycle through first, second, third, and fourth operational positions, as described herein, so long as pressurized air is supplied to adapter 110.

Figure 17:
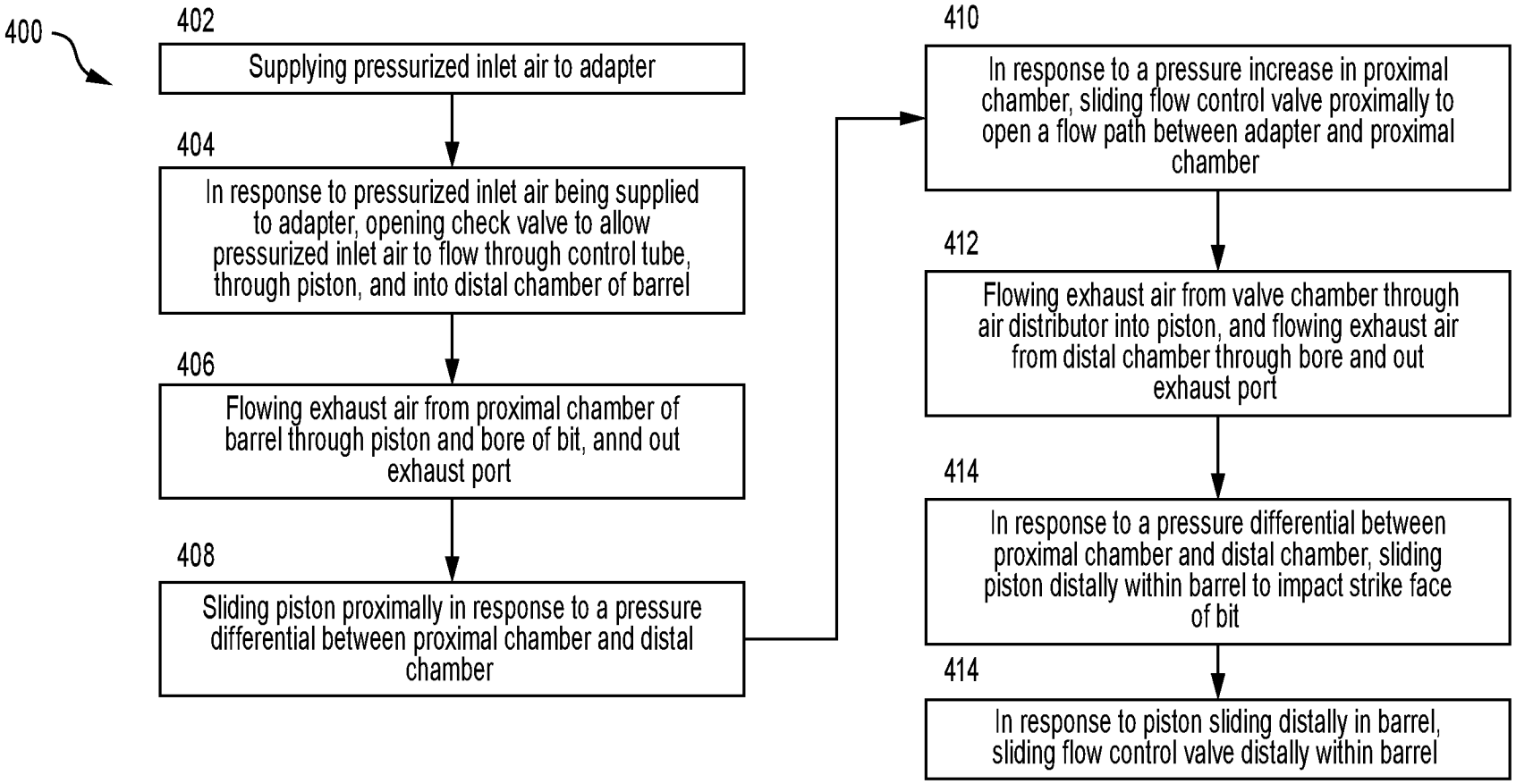
FIG. 17 provides a flowchart depicting an exemplary method for operating a down-the-hole hammer, according to aspects of the present disclosure.

FIG. 17 is a flow diagram illustrating an exemplary method 400 for operating hammer 100 to drill a hole, by cycling hammer through the first, second, third, and fourth operational positions of FIGS. 8-16B. Steps 402-416 of method 400 may be performed automatically in response to a continuous supply of pressurized air to hammer 100. Method 400 includes, at step 402, supplying pressurized inlet air to adapter 110 of hammer 100. Pressurized air may be supplied by a remotely mounted compressor and fed through drill string attached to adapter 110.

Method 400 further includes, at step 404, in response to pressurized inlet air being supplied to adapter 110 at step 402, opening check valve 130 to allow pressurized inlet air to flow through control tube 140, through piston 160, and into distal chamber 202 of barrel 102. Opening check valve 130 may occur automatically in response to inlet air exerting a predetermined pressure on plug 132 of check valve 130. The pressurized inlet air may flow in the direction of arrow 300 of FIGS. 8 and 9, as described herein. In flowing through piston 160, the pressurized inlet air may flow into proximal internal cavity 168 from control tube 140, through second port(s) 172 to recess 108 of barrel 102, and through passageway(s) 178 to reach distal chamber 202.

Method 400 further includes, at step 406, flowing exhaust air from proximal chamber 200 of barrel 102 through piston 160 and bore 126 of bit 120, and out exhaust port 128. The exhaust air may flow in the direction of arrow 302 of FIGS. 8 and 9. In flowing through piston 160, the exhaust air flows into enlarged section 167 of proximal internal cavity 168, through first port(s) 170 into intermediate chamber 206, and through third port(s) 176 into distal internal cavity 174 to bore 126. From bore 126, the exhaust air is free to flow to exhaust port 128 and escape to the atmosphere.

Step 406 may occur concurrently with, or overlap in time with, step 404. Steps 404 and 406 correspond to hammer 100 being in the first operational position of FIGS. 8 and 9, as described herein.

Method 400 further includes, at step 408, sliding piston 160 proximally along longitudinal axis 101 in response to a pressure differential between proximal chamber 200 and distal chamber 202. In particular, distal chamber 202 increases in pressure relative to proximal chamber due to inlet air flowing into distal chamber 202 at step 404, and exhaust air flowing out of proximal chamber 200 at step 406. Step 408 corresponds to hammer 100 being in the second operational position of FIGS. 10 and 11, as described herein.

Method 400 further includes, at step 410, in response to a pressure increase in proximal chamber 200, sliding valve member 181 proximally to open a flow path between adapter 110 and proximal chamber 200. The pressure increase in proximal chamber 200 results from piston 160 continuing to slide proximally in barrel 102 due to the pressure differential between proximal chamber 200 and distal chamber 202, as described with reference to step 408. The increased pressure in proximal chamber 200 forces valve member 181 proximally away from distal surface 192 of valve seat 190. Inlet air is thus able to flow past check valve 130, though flange port 154 of air distributor 150, between valve member 181 and valve seat 190, and into proximal chamber 200, as illustrated by arrow 306 of FIG. 12.

Method 400 further includes, at step 412, flowing exhaust air from valve chamber 204 through air distributor 150 into piston 160, and flowing exhaust air from distal chamber 202 through bore 126 and out exhaust port 128. Flowing exhaust air from valve chamber 204 may occur in response to valve chamber 204 being pressurized (i.e., reduced in volume) by proximal sliding of valve member 181 at step 410. The exhaust air flows, in particular, from valve chamber 204 through proximal port(s) 155 of air distributor 150, through bore 151 of air distributor within recess 144 of control tube 140, through distal port(s) 156 of air distributor 150, and into proximal internal cavity 168 of piston 160. That is, the exhaust air flows in the direction of arrow 308 of FIG. 12. Moreover, the exhaust air within distal chamber 202 flows through bore 126 and out exhaust port 128, in the direction of arrow 304 of FIG. 12.

Step 412 may occur concurrently with, or overlap in time with, step 410. Steps 410 and 412 correspond to hammer 100 being in the third operational position of FIGS. 12, 13, and 16, as described herein.

Method 400 further includes, at step 414, in response to a pressure differential between proximal chamber 200 and distal chamber 202, sliding piston 160 distally within barrel 102. In particular, pressure in proximal chamber 200 is greater than pressure in distal chamber 202 due to inlet airflow into proximal chamber 200 (at step 410) and exhaust airflow out of distal chamber 202 (at step 412). Thus, the relatively higher pressure in proximal chamber 200 forces piston 160 to slide distally within barrel 102, eventually causing piston 160 to impact strike face 129 of bit 120.

Method 400 further includes, at step 416, in response to piston 160 sliding distally in barrel 102, sliding valve member 181 distally within barrel 102. Particularly, once piston 160 slides clear of distal port(s) 156 of air distributor 150 during step 414, distal port(s) 156 is in fluid communication with proximal chamber 200. Inlet air flowing into proximal chamber 200 flows through distal port(s) 156, into bore 151 of air distributor 150, out proximal port(s) 155 of air distributor 150, and into valve chamber 204, in the direction of arrow 312 of FIG. 14. The subsequent increase in air volume in valve chamber 204 causes valve member 181 to slide distally, which increases the volume of valve chamber 204. As a result of valve member 181 sliding distally, distal surface 182 of valve member 181 engages distal surface 192 of valve seat 190, thereby preventing further flow of inlet air from flange port 154 or air distributor 150 into proximal chamber 200.

Step 416 may occur concurrently with, or overlap in time with, step 414. Steps 414 and 416 correspond to hammer 100 being in the fourth operational position of FIGS. 14 and 15, as described herein. As mentioned, piston 160 continues to slide distally at step 414 until piston 160 impacts strike face 129, thus returning hammer 100 to first operational position of FIGS. 8 and 9.

Steps 402-416 of method 400 are then repeated as long as pressurized air is supplied to adapter 110. As such, an impact force is repeatedly applied to strike face 129 of bit 120, and the impact force is in turn transferred to the ground/rock surface engaged by digging feature(s) 122 of bit 120. Repetition of method 400 thus causes hammer 100 to drill into ground/rock surface.

The hammer 100 and method of the present disclosure allows for a relatively long piston stroke, which results in more efficient drilling. In particular, flow control valve 180 occupies a relatively small space within proximal end 104 of barrel 102, leaving more room for piston 160 to travel. Further, due to inclusion of ports 170, 172, 176 within piston 160, airflow between proximal chamber 200 and distal chamber 202 is governed by piston 160 itself in conjunction with flow control valve 180 without the need for another flow-control component taking up space in barrel 102 and adding complexity to hammer 100.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A down-the-hole hammer comprising:

a barrel having a longitudinal axis and defining a proximal chamber and a distal chamber;

a piston slidable within the barrel between the proximal chamber and the distal chamber; and a flow control valve comprising a valve member slidable within the barrel along the longitudinal axis to control airflow through the piston, wherein, in a first position of the valve member, the valve member allows air flow from a proximal end of the barrel through the piston and into the distal chamber, bypassing the proximal chamber, and wherein, in a second position of the valve member, the valve member allows air flow around the valve member and into the proximal chamber.

2. The down-the-hole hammer of claim 1, further comprising:

an adapter for receiving inlet air connected to a proximal end of the barrel; and a bit connected to a distal end of the barrel.

3. The down-the-hole hammer of claim 1, wherein, in the first position of the valve member, the valve member engages a valve seat to prevent air from flowing into the proximal chamber; and wherein, in the second position of the valve member, the valve member is spaced apart from the valve seat to allow air flow between the valve member and the valve seat into the proximal chamber.

4. The down-the-hole hammer of claim 1, wherein the flow control valve defines a valve chamber, and wherein sliding the valve member distally increases a volume of the valve chamber.

5. The down-the-hole hammer of claim 4, further comprising:

an air distributor comprising:

at least one proximal port in fluid communication with the valve chamber of the flow control valve, and at least one distal port spaced apart from the at least one proximal port.

6. The down-the-hole hammer of claim 1, further comprising:

a check valve configured to open at a predetermined pressure to allow inlet air to flow into the barrel.

7. The down-the-hole hammer of claim 1, further comprising:

a control tube having a hollow bore extending parallel to the longitudinal axis, wherein the control tube has a distal end extending into a proximal internal cavity of the piston.

8. The down-the-hole hammer of claim 1, wherein the piston comprises:

a proximal internal cavity;

a distal internal cavity, axially aligned with the proximal internal cavity;

at least one first port extending from the proximal internal cavity to an intermediate outer surface of the piston;

at least one second port extending from the proximal internal cavity to a distal outer surface of the piston; and at least one third port extending from the distal internal cavity to the intermediate outer surface of the piston.

9. The down-the-hole hammer of claim 8, wherein the piston comprises one or more passageways extending from a distal end of the distal outer surface toward the intermediate outer surface.

10. The down-the-hole hammer of claim 9, wherein the one or more passageways terminate distally of the at least one second port.

11. A down-the-hole hammer comprising:

a barrel having a longitudinal axis and defining a proximal chamber and a distal chamber;

a piston slidable within the barrel between the proximal chamber and the distal chamber, the piston including:

a distal outer surface, an intermediate outer surface, a proximal internal cavity, a distal internal cavity, and one or more passageways extending from a distal end of the distal outer surface towards the intermediate outer surface; and a flow control valve comprising a valve member slidable within the barrel along the longitudinal axis to control airflow through the piston, wherein, in a first position of the valve member, the valve member allows air flow from a proximal end of the barrel through the piston and into the distal chamber, wherein, in a second position of the valve member, the valve member allows air flow around the valve member and into the proximal chamber, and wherein in the first position of the valve member, the air flow bypasses the proximal chamber.

12. The down-the-hole hammer of claim 11, further comprising:

at least one first port extending from the proximal internal cavity to the intermediate outer surface of the piston; and at least one second port extending from the proximal internal cavity to the distal outer surface of the piston, wherein the one or more passageways terminate distally of the at least one second port.

13. The down-the-hole hammer of claim 11, wherein, in the first position of the valve member, the valve member engages a valve seat to prevent air from flowing into the proximal chamber; and wherein, in the second position of the valve member, the valve member is spaced apart from the valve seat to allow air flow between the valve member and the valve seat into the proximal chamber.

14. The down-the-hole hammer of claim 11, wherein the flow control valve defines a valve chamber, and wherein sliding the valve member distally increases a volume of the valve chamber.

15. The down-the-hole hammer of claim 14, further comprising:

an air distributor comprising:

at least one proximal port in fluid communication with the valve chamber of the flow control valve, and at least one distal port spaced apart from the at least one proximal port.

16. The down-the-hole hammer of claim 11, wherein the distal internal cavity of the piston is axially aligned with the proximal internal cavity of the piston.

17. A down-the-hole hammer comprising:

a barrel having a longitudinal axis and defining a proximal chamber and a distal chamber;

a piston slidable within the barrel between the proximal chamber and the distal chamber, the piston including:

a proximal internal cavity, a distal internal cavity, at least one first port extending from the proximal internal cavity to an intermediate outer surface of the piston, at least one second port extending from the proximal internal cavity to the distal outer surface of the piston, and at least one third port extending from the distal internal cavity to the intermediate outer surface of the piston, and one or more passageways extending from a distal end of a distal outer surface toward an intermediate outer surface; and a flow control valve comprising a valve member slidable within the barrel along the longitudinal axis to control airflow through the piston, wherein, in a first position of the valve member, the valve member allows air flow from a proximal end of the barrel through the piston and into the distal chamber, and wherein, in a second position of the valve member, the valve member allows air flow around the valve member and into the proximal chamber.

18. The down-the-hole hammer of claim 17, wherein in the first position of the valve member, the air flow bypasses the proximal chamber.

19. The down-the-hole hammer of claim 17, wherein in the first position of the valve member, the valve member engages a valve seat to prevent air from flowing into the proximal chamber; and wherein, in the second position of the valve member, the valve member is spaced apart from the valve seat to allow air flow between the valve member and the valve seat into the proximal chamber.

* * * * *